US006568112B2

(12) United States Patent
Lowry et al.

(10) Patent No.: US 6,568,112 B2
(45) Date of Patent: May 27, 2003

(54) LABEL AND SIGN HOLDER

(75) Inventors: Michael G. Lowry, Margate, FL (US); Robert Fast, Ft. Lauderdale, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 0 days.

(21) Appl. No.: 10/101,726

(22) Filed: Mar. 21, 2002

(65) Prior Publication Data

US 2003/0019140 A1 Jan. 30, 2003

Related U.S. Application Data

(63) Continuation-in-part of application No. 09/907,588, filed on Jul. 19, 2001, now abandoned.

(51) Int. Cl.[7] ..... G09F 3/18
(52) U.S. Cl. ..... 40/661.03; 40/649
(58) Field of Search ..... 40/661.03, 642.02, 40/661.08, 649

(56) References Cited

U.S. PATENT DOCUMENTS

| | | | | | |
|---|---|---|---|---|---|
| 4,485,575 | A | | 12/1984 | Fast | |
| 4,513,313 | A | | 4/1985 | Fast | |
| 4,557,064 | A | * | 12/1985 | Thompson | 40/661.03 |
| 4,625,441 | A | | 12/1986 | Fast | |
| 4,704,813 | A | | 11/1987 | Fast | |
| 4,713,899 | A | | 12/1987 | Fast | |
| 4,917,342 | A | | 4/1990 | Fast | |
| 4,995,182 | A | | 2/1991 | Fast | 40/649 |
| 5,394,632 | A | * | 3/1995 | Gebka et al. | 40/661.03 |
| 5,419,066 | A | * | 5/1995 | Harnois et al. | 40/661.03 |
| 5,458,307 | A | | 10/1995 | Gebka | 40/618 |
| 5,488,793 | A | | 2/1996 | Gebka et al. | |
| 5,515,632 | A | | 5/1996 | Gebka et al. | 40/649 X |
| 5,682,698 | A | | 11/1997 | Bevins | 40/661.03 |
| 5,899,011 | A | | 5/1999 | Brinkman | 40/661.03 |
| 6,026,603 | A | | 2/2000 | Kump et al. | 40/661.03 |
| 6,082,687 | A | | 7/2000 | Kump et al. | 248/220.41 |
| 6,105,295 | A | | 8/2000 | Brinkman et al. | 40/661.03 |
| 6,119,990 | A | | 9/2000 | Kump et al. | |
| 6,145,232 | A | * | 11/2000 | Bevins | 40/661.03 |
| 6,163,996 | A | | 12/2000 | Gebka | 40/661.03 |
| 6,266,906 | B1 | * | 7/2001 | Nagel | 40/661.03 |

* cited by examiner

*Primary Examiner*—Joanne Silbermann
(74) *Attorney, Agent, or Firm*—Jacobson Holman PLLC

(57) ABSTRACT

A merchandising aid in the nature of a combined label/sign holder wherein a sign holder is carried directly by the cover member of the label holder so that the label holder pocket can be readily accessed for insertion or replacement of non-adhesive labels therein without interference from the sign holder. Incorporation of sign holder-supporting members on the cover member of a label holder is shown as particularly advantageous in label holders having locking portions designed to preclude the accidental movement of labels carried thereby. Upper and/or lower grips may also be formed on the cover member to slidingly receive and removably retain additional labels and/or signs without interfering with other merchandise information members.

34 Claims, 4 Drawing Sheets

LABEL AND SIGN HOLDER

This application is a continuation-in-part of application Ser. No. 09/907,588 filed Jul. 19, 2001, now abandoned the subject matter of which is incorporated herein in its entirety by reference.

BACKGROUND OF THE INVENTION

1. Field of the Invention

This invention relates to merchandising aids, and relates more particularly to a combination label holder/sign holder to be secured to a supporting surface, such as a C-channel formed along the front edge of a merchandising shelf. The label holder portion of the merchandising aid is designed to removably receive non-adhesive labels to display consumer information such as descriptions and prices of products on the shelf, as well as inventory control information, such as barcodes and the like. The sign holder portion of the merchandising aid is adapted to carry a "flag" or sign displaying special information to the consumer, such as identifying a "sale" item or the like.

2. Discussion of the Related Art

Shelves with C-channels along the front edge are commonly found in merchandise outlets such as supermarkets, pharmacies and the like, the C-channel being formed with spaced upper and lower opposed lips to provide a convenient means for mounting many different kinds of fit-in articles, such as labels, signs or sign holder which provide information relating to the merchandise displayed on the shelf. Adhesive-backed labels can be secured directly to a supporting surface, such as the side of a warehouse shelf, or even directly on the surface of a C-channel. However, removing such adhesive-backed labels is time consuming and difficult, leaving an unsightly residue build-up. For many applications, therefore, non-adhesive paper or plastic labels are preferred since they can easily be replaced if they become damaged or the product information changes. While such non-adhesive labels can sometimes simply be fitted directly between the lips of the C-channel, more commonly, label holders are provided which have a back or body panel attached in some fashion to the supporting surface, with a transparent cover member flexibly secured along one mating edge to the body panel to define between the front surface of the body panel and the rear surface of the cover member a pocket for removable reception of one or more such information-containing labels.

Label holders are generally provided in elongated sections, perhaps 4' or more in width, and may be secured by adhesive strips or the like to any supporting surface such as the side of a shelving or warehouse unit. However, most applications for such label holders are directly on the front flange or in the C-channel of the front edge of a product display shelf. Various prior art embodiments of such label holders can be seen in commonly assigned U.S. Pat. Nos. 4,713,899, 5,458,307, 5,488,793, 5,515,632, 5,682,698, 5,899,011 and 6,105,295, the disclosures of which are incorporated herein in their entireties by reference.

Oftentimes, in addition to the information provided by the product labels, it is desired to highlight certain information about a particular product or group of products by displaying an enlarged "flag" or sign on the shelf, depending from the portion of the shelf carrying such products, or extending into the aisle at such a location. Different forms of "sign holders" are also well known in the merchandising art, examples of which can be seen in the aforementioned U.S. Pat. No. 5,488,793, as well as commonly assigned U.S. Pat. Nos. 4,485,575, 4,531,313, 4,625,441, 4,704,813, 4,917,342, 4,995,182, 5,682,698, and 6,163,996, the subject matters of which are also incorporated herein in their entireties by reference.

Separate sign holders can simply be positioned on the shelf itself, or juxtaposed to the shelf in the aisle. Yet, such an arrangement may not be stable, can waste valuable product display space, and can even cause damage to consumers. For that reason, as seen in some of the aforementioned patents, such sign holders may be designed to be supported partially or entirely in the same C-channels as the label holders.

While constructions of this nature are convenient in some respects, significant difficulties are encountered when it is necessary to insert new labels or to remove or replace labels already carried in the underlying label holder. In order to access the label holder pocket, any and all sign holders secured in front of and, therefore, overlying the label holder must first be removed, and subsequently replaced. This is time consuming, labor intensive, and obviously inefficient, particularly when using elongated label holders that may have multiple sign holders engaged along their length.

Moreover, in some instances, or in respect of some portions of an extended product shelf, it may be desirable to support labels or signs of different configurations on the same merchandising aid, avoiding the need to remove or replace a label or sign holder whenever the nature of the goods, or the information to be presented with respect to the goods, is changed. A merchandising aid or label/sign holder capable of accommodating such variations would be highly desirable.

SUMMARY OF THE INVENTION

It is primary object of the instant invention, therefore, to provide a merchandising aid in the form of a combination label/sign holder wherein labels can be selectively inserted and removed from the label holder pocket without removing any of the sign holders associated with related products.

A further object of this invention is the provision of a combination label/sign holder wherein the supporting means for the sign holder are part of the cover member of the label holder so that when the cover member of the label holder is flexed away from the base panel to remove or insert new labels, the sign holders are carried by, and move with, the cover member and do not interfere with access to the label holder pocket.

Consistent with the foregoing, the front surface of the cover member of the label holder is provided with a pair of sign holder-receiving lip members which can snappingly receive edge portions of a resilient plastic or metal sign holder such as seen in aforementioned U.S. Pat. No. 5,488,793, or the engaging portions of a depending sign holder of the type seen in aforementioned U.S. Pat. Nos. 5,682,698 and 6,163,996, or other such commercially available sign holders.

Another object of this invention is the incorporation of the unique combination label/sign holder construction hereof in any of a variety of label holder designs, particularly label holders having a locking construction to secure paper or the like labels in the pocket, with a ledge or other finger-engaging element adapted to facilitate opening the label holder for insertion or removal of labels from the pocket, wherein engagement of a sign holder in the same C-channel can sometimes interfere with the locking and releasing mechanism on the label holder.

Yet, another object of this invention is to provide the front surface of the transparent cover member of a label holder of the type described with an upper "grip" member adapted to slidingly receive and removably retain an additional label or the like without having to open the cover member or disturb the labels within the pocket formed between the cover member and the body panel of the label holder, and without disturbing any signs carried by other portions of the cover member.

A still further object of this invention is to provide the front surface of the transparent cover member of such a label holder with a lower "grip" member adapted to slidingly receive and removably retain a different label or portions of a depending sign holder which is of insufficient length to span the spacing between the sign holder-receiving lip members carried by the cover member.

Other and further objects of the instant invention will become apparent from the ensuing description and claims read in conjunction with the attached drawings.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings:

FIG. 4 is a fragmentary perspective view of yet a further embodiment of combination label/sign holder according to this invention incorporating an upper grip member on the cover member to enable an additional label, one of which is schematically shown in dotted lines, to be carried by the merchandising aid, and illustrating a modified support element to secure the merchandising aid in a C-channel or the like.

Like reference characters refer to like part throughout the several views of the drawings.

DETAILED DESCRIPTION OF THE PREFERRED EMBODIMENTS

Figure 1:
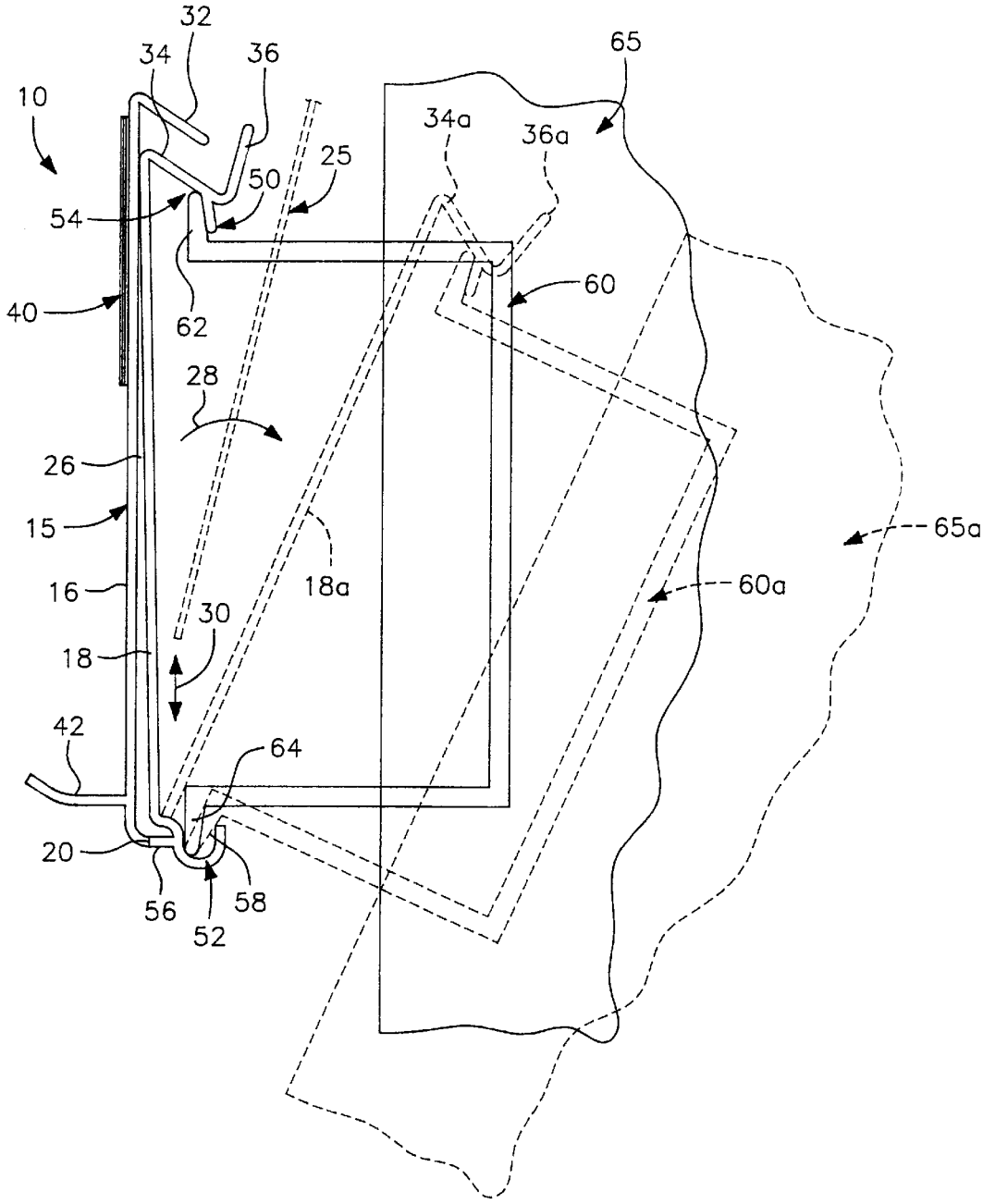
FIG. 1 is a side elevational view of one embodiment of a combination label/sign holder according to the instant inventive concepts, with the cover member and an associated sign holder illustrated in an open position in dotted lines for removal or replacement of a label, parts being broken away for illustrative clarity and convenience.
Figure 2:
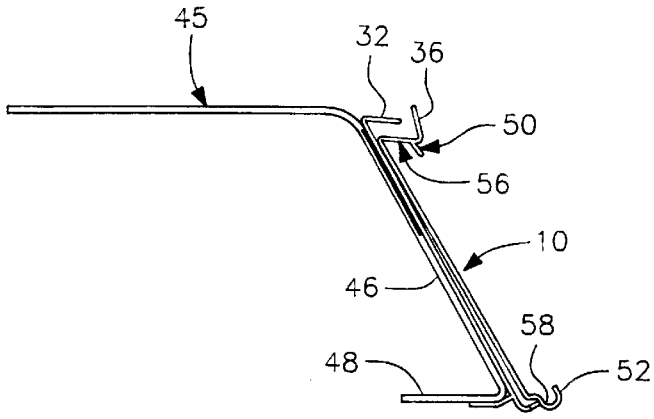
FIG. 2 is a reduced scale schematic view showing the manner in which the combination label/sign holder of FIG. 1 may be affixed to one form of merchandising shelf front flange.

Referring initially to FIGS. 1 and 2, one embodiment of a merchandising aid in the nature of a combined label/sign holder according to the instant inventive concepts is designated generally by the reference numeral 10. The merchandising aid 10 includes a label holder portion 15 formed by a back or body panel 16 and a cover member 18 flexibly secured to each other at a hinge or pivot portion 20. The material from which the merchandising aid is made is not critical to the instant inventive concepts, although, commercially, such products are co-extruded from plastics materials, with the body panel 16 being formed of an opaque plastic and the cover member 18 being formed of a transparent material to enable passers-by to view information on a label shown in dotted at 25 captured in a pocket 26 formed between the front surface of the body panel 16 and the rear surface of the cover member 18.

The cover member 18 can be tipped forwardly in the direction of the arrow 28 to the position shown in dotted line at 18*a* to facilitate the insertion or removal of the label 25 in the direction of the arrows 30. The resilient nature of the hinge 20 will then normally bias the cover member 18*a* back to the solid line position shown at 18 to retain the label 25 in the pocket 26.

In a preferred embodiment as shown in FIG. 1, the upper edge portions of the base panel 16 include a forwardly and downwardly extending flange 32 and the upper edge portions 34 of the cover member 18 are lockingly engageable under the flange 32 to retain the cover member and secure the label 25 in the pocket 26, particularly in the event the resilience of the connection between the base panel 16 and the cover member 18 weakens with continued use of the label holder 15. A downwardly and then forwardly and upwardly extending finger-engaging element 36 is preferably carried by the upper edge portions 34 of the cover member 18 to facilitate release of the upper edge portions 34 of the cover member 18 from the locking engagement with the flange 32 of the base panel 16.

The manner in which the merchandising aid 10 is secured to a supporting surface will vary depending upon the nature of the supporting surface itself as will be readily recognized by those with ordinary skill in this art and is not a critical part of the instant invention concepts. For example, in the embodiment of FIG. 1, an adhesive tape is illustrated at 54 with a resilient rearwardly and upwardly extending arm 42 carried by the bottom of the rear surface of the base member 16. This embodiment is particularly well adapted to secure the merchandising aid 10 to the front lip of a merchandise shelf such as shown schematically at 45 in FIG. 2, the lip having a forwardly and downwardly extending portion 46 to which the adhesive 40 of the merchandising aid 10 can be secured with a rearwardly extending lower flange 48 under which the arm 42 is resiliently engaged. The merchandising aid may be entirely held-in position on the shelf lip by an adhesive backing or, for that matter, may be secured by adhesive or other means to a side surface of a warehouse shelf or the like, or secured to a C-channel at the front of a merchandise shelf.

The portions of the embodiment of the instant invention shown at 10 in FIG. 1 that have been described to this point are found in many prior art label holder devices. The particularly unique and commercially desirable feature of the merchandising aid 10 of this invention resides in the manner in which the cover member 18 of the label holder portion 15 carries a sign holder such that the label holder can be opened without removing the sign holder. To that end, a pair of sign holder-receiving lip members 50, 52 are integrally formed on the cover member 18, i.e., by extrusion. The upper sign holder-receiving lip member 50 extends forwardly and downwardly from the upper edge portions 34 of the cover member 18 behind the finger-engaging element 36 to form an upper sign holder-receiving pocket 54, and the lower sign holder-receiving lip member 52 extends forwardly and upwardly from the lower edge portions 56 of the cover member 18 to define a lower sign holder-receiving pocket 58.

In the embodiment of FIG. 1, a well-known spring clip form of sign holder is designated generally by the reference numeral 60 and includes a spring plastic or metal element having oppositely extending edge portions 62, 64 adapted to be snappingly engaged in the sign holder-receiving pockets 56, 58, respectively, in an obvious manner. Although not shown in detail in FIG. 1, the sign holder 60, which is part of the prior art, has a central slit or opening adapted to grippingly engage a plastic or cardboard "flag" or sign, a fragmentary portion of which is designed generally by the reference numeral 65.

The merchandising aid 10 can be of any dimensions, but, as noted above, is generally marketed in elongated sections which can receive and retain multiple labels 25, each of which is adapted to contain consumer and inventory information related to products on a merchandise shelf and display such information to passers-by or store personnel through the transparent cover member 18. The flag or sign 65, on the other hand, in a sign holder such as shown at 60 in FIG. 1, is extended into the aisle in a manner to more prominently display special product information to consumers passing in either direction.

By supporting the sign holder 60 directly on the cover member 18 of the label holder portion 15 of the merchandising aid 10, the cover member 18 can be tilted forwardly as seen in dotted lines at 18*a* in FIG. 1 for insertion or removal of a label 25 without interference from the sign holder 60, seen in dotted lines at 60*a*, since the sign holder 60*a* with its accompanying sign 65*a* remains in position on the cover member 18*a* and moves therewith. In this manner, it is possible for store personnel to readily remove or replace new labels at any point along the length of a section of label holder without removing any or all of the sign holders associated therewith.

Figure 3:
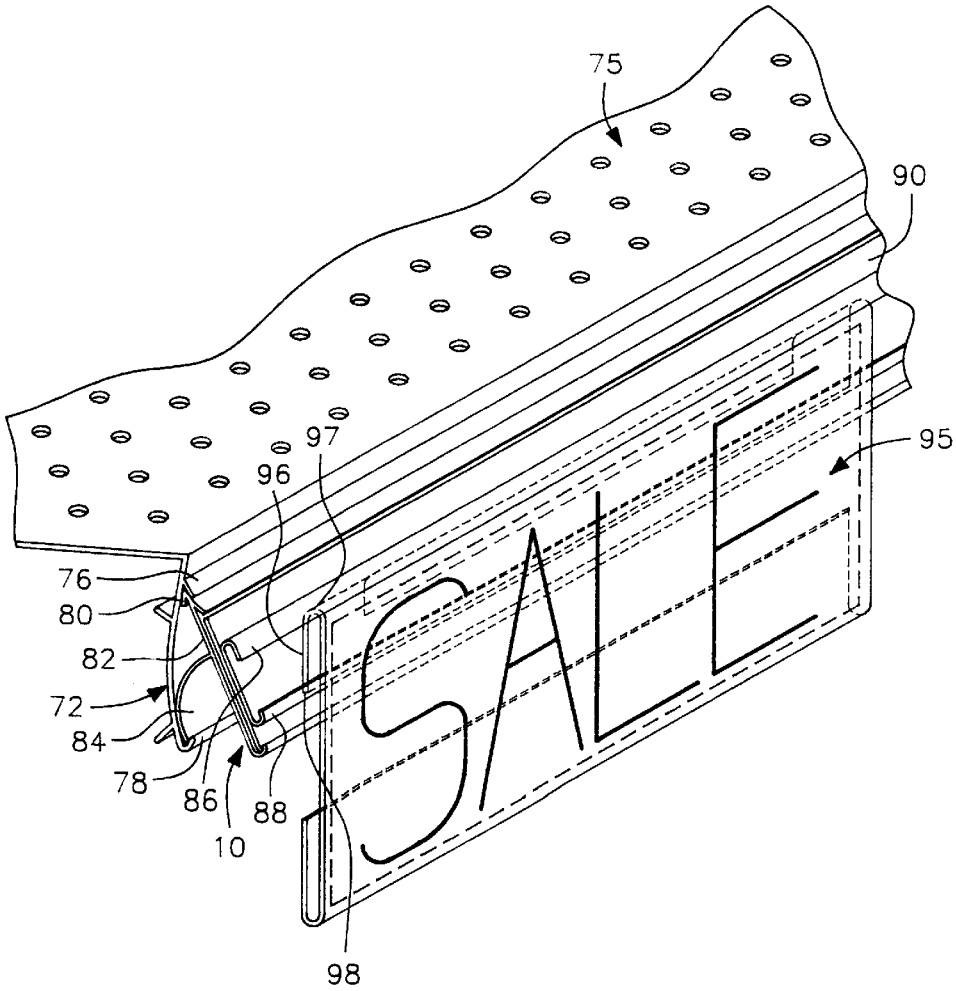
FIG. 3 is a perspective view of an alternative combination label/sign holder according to this invention illustrating the manner in which it can be secured in a C-channel of a merchandise shelf and carry a different form of sign holder from the embodiment of FIG. 1.

Reference is now made particularly to FIG. 3 wherein a further embodiment of label/sign holder according to the instant invention concepts is designed generally by the reference numeral 70 and is illustrated as secured in a C-channel 72 of a merchandise shelf 75. In this instance, as is common, the C-channel 72 includes a downwardly depending upper lip 76 and an upwardly extending lower lip 78 forming spaced, opposed pockets for reception of portions of a label, a label holder or a prior art sign holder in a well-known manner. In the illustrated embodiment, the label holder 70 is shown as having the upper edge portion 80 of the back panel 82 engaged under the upper lip 76 of the C-channel 72 with an elongated flexible finger 84 carried intermediate the rear surface of the back panel 82, the lower edge of which is engaged above the lower lip 78 of the C-channel 72. Such a construction is seen, for example, in aforementioned U.S. Pat. No. 5,488,793. Of course, as suggested above, this manner of attaching the merchandising aid of this invention to a C-channel is illustrative and it will be recognized by those of ordinary skill in the art that numerous other well-known C-channel-engaging means, many of which are illustrated in the aforementioned patents, could be readily substituted therefor without departing from the instant inventive concepts.

The merchandising aid 70 is shown as having elongated upper and lower sign holder-receiving lip members 86, 88 integrally formed on the front surface of the transparent cover member 90, although a separate element containing the sign holder-receiving channels can be adhesively secured to the front surface of the cover member, if desired. In FIG. 3, a different form of sign holder, designated generally by the reference numeral 95 of the type seen, for example, in aforementioned U.S. Pat. Nos. 5,682,698 and 6,163,996, is illustrated. The sign holder 95 includes a reverted upper flap 96 with an upper bight portion 97 defining an elongated upper edge engaged in the pocket behind the upper sign holder-receiving lip member 86 and a free lower edge 98 received in the pocket behind the lower sign holder-receiving lip member 88. The cover member 90 of the merchandising aid 70 can be tilted forwardly, in a manner similar to that shown in dotted lines in FIG. 1, to substitute labels, with no need to remove the sign holder 95 since it is carried by, and moves with, the cover member 90.

Figure 4:
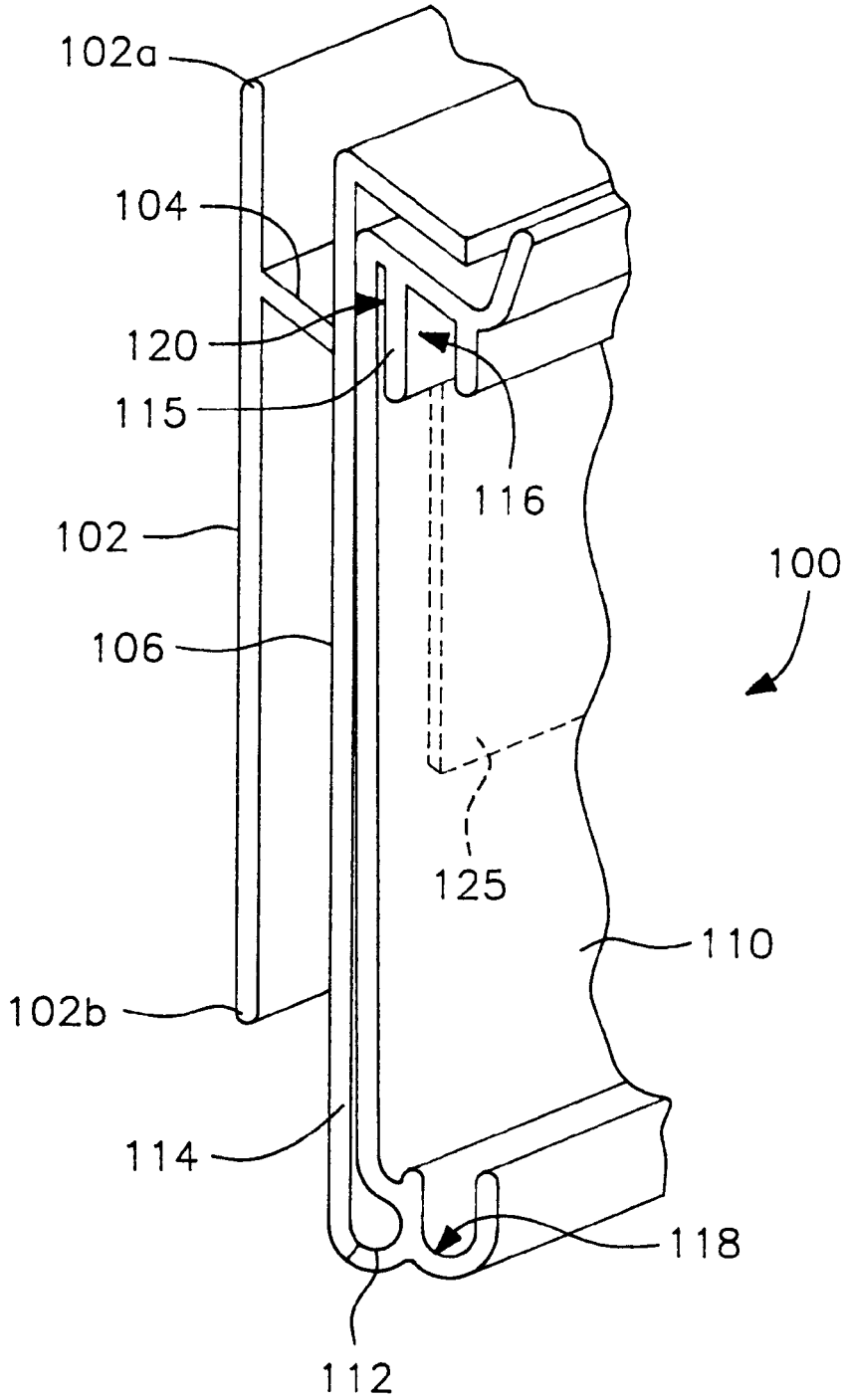

Reference is now made particularly to FIG. 4 which shows yet another modified combination label/sign holder according to the instant invention designated generally by the reference numeral 100. This embodiment illustrates yet another form of means to support the label/sign holder, namely a generally vertically extending rear panel element 102 attached by a horizontal element 104 to the rear of the base panel 106 of the label holder portion 108, which includes the transparent cover member 110 resiliently secured to the back panel 106 at 112 to define a pocket 114 therebetween for removable reception of a label (not shown) in the manner described with respect to the previous embodiments. The upper and lower edges 102*a*, 102*b* of the rear panel element 102 can be snappingly engaged between the upper and lower lips of a C-channel of the type seen, for example, in the embodiment of FIG. 3. This particular means for supporting the label/sign holder 100 is shown simply for illustrative purposes to emphasize the many ways in which the merchandising aid of this invention can be secured to a supporting surface.

Other than the supporting means, the combination label/sign holder 100 of FIG. 4 is, for all intents and purposes, substantially identical to the label/sign holder 10 seen in FIGS. 1 and 2, with the exception of the incorporation of an additional upper grip member 115 behind the elements forming the upper sign holder-receiving pocket 116, which cooperates with the lower sign holder-receiving pocket 118 to support a sign holder (not shown) on the front face of the transparent cover member 110 in the manner discussed previously. The upper grip member 115 is an additional element closely positioned to the upper edge portions of the front face of the transparent cover member 110 to define between them a small pocket 120 adapted to slidingly receive and removably retain by friction the upper edge portions of an additional label or the like seen in dotted lines at 125.

With the structure of the combination label/sign holder of FIG. 4, the merchandising aid has yet a further facility, that is, not only can it carry labels at selected locations along its length in the pocket 114 between the base member 106 and the transparent cover member 110, and selected sign holders between the upper and lower sign holder-receiving pockets 116, 118, but it can also selectively receiving additional labels 125 on the face of the cover member 110 at any point along its length without interfering with the unique ability of the label/sign holder of this instant invention to permit forward tilting of the cover member to remove and insert labels in the pocket 114 without interference with or from sign holders or additional labels carried on the front face of the transparent cover member 110.

Figure 5:
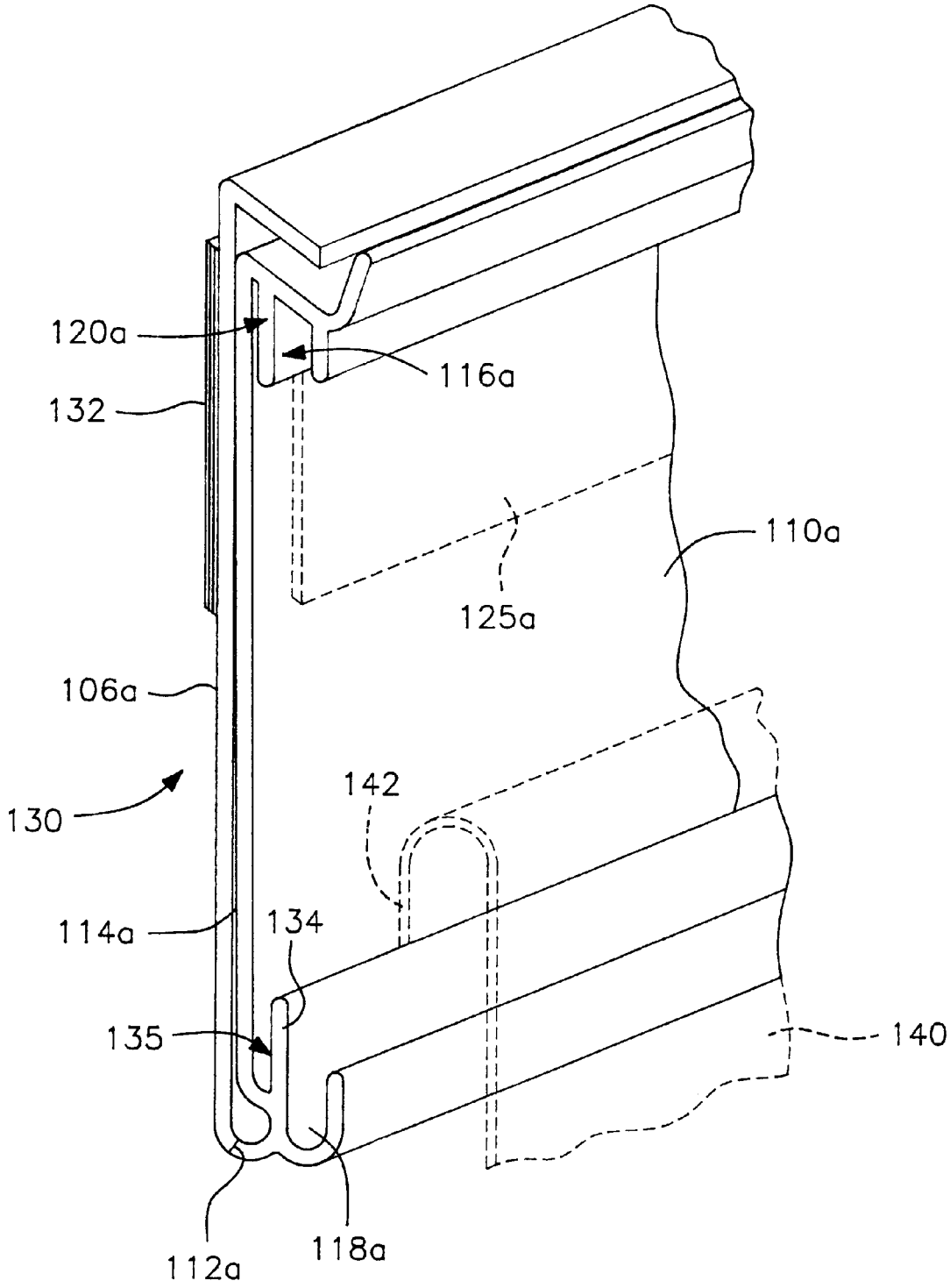
FIG. 5 is a similar view of yet another embodiment of combinational label/sign holder according to this invention incorporating upper and lower grip members on the cover member to enable additional labels, as well as a sign or sign holder of a different configuration, to be carried by the merchandising aid.

With reference now to FIG. 5, yet another modification of a combination label/sign holder according to this invention will be seen generally at 130, wherein parts similar to those in FIG. 4 are designated by the same reference numeral followed by the suffix "a". This embodiment, merely for illustrative purposes, is seen as carrying an adhesive backing 132 to secure the same to any desired supporting surface.

The label/sign holder 130 of FIG. 5, in addition to the upper grip 115*a*, includes a lower grip 134 behind the lower sign holder-receiving pocket 118*a*, and defining a small lower pocket 135. The pocket 135 enables the combination label/sign holder 130 to not only receive an additional label 125*a* behind the upper grip 116*a,* but an additional label (not shown) can also be slidingly and removably retained in the pocket 135 of the lower grip 134. Moreover, a depending sign or sign holder such as shown in dotted lines at 140 in FIG. 5, which is not dimensioned to span the space between the upper and lower sign holder-receiving pockets 116*a,* 118*a,* as in the embodiment of FIG. 3, can have its reverted edge portions 142 slidingly and removably retained by friction or gravity behind the lower grip 134, with the sign depending below the label and sign holder 130 as illustrated.

Of course, a combination label/sign holder containing only a lower grip, but not an upper grip, can be provided, but the construction seen in FIG. 5 has maximum versatility, enabling labels and signs of multiple configurations to be readily carried along its length, providing consumers and store personnel with a variety of information sources, all of which can be readily removed and/or replaced at any time without disturbing the remaining elements. Obviously, a sign holder such as shown at 95 in FIG. 3 and/or a sign holder such as shown at 130 in FIG. 5, can be carried by a merchandise aid such as shown at 10 in FIG. 1, and vice-versa. Similarly, numerous other label holder-engaging or supporting means can be substituted for those illustrated in FIGS. 1–5 without departing from the instant inventive concepts. Regardless of the construction of the label-holder supporting means and the specific sign holder, the combination label/sign holder of this invention is much simpler to use, saving valuable labor while providing the merchandiser with great flexibility in readily presenting specific product/inventory information in the label holder portion or in the grip portions and more prominently displaying special "sale" or the like information in the sign holder portion or the grip portions. Moreover, the ability to carry the sign holder on the cover member itself is particularly advantageous with label holders having locking means of the type shown herein which tend to interfere with the ability to secure the sign holder directly in the C-channel.

While only preferred embodiments of the instant inventive concept have been described herein in detail, the invention is not limited thereby and modifications can be made within the scope of the attached claims.

What is claimed is:

1. A merchandising aid for displaying at least one information-containing label and for supporting at least one sign holder adapted to display an information-containing sign, said merchandising aid being adapted to be secured to a supporting surface and including a label holder having a body panel and a transparent cover member, said body panel and said cover member each having front and rear surfaces and upper and lower edge portions, said body panel and said cover member being flexibly secured to each other at only one of their respective upper and lower edges to define between said front surface of said body panel and said rear surface of cover member a pocket for removable reception of one or more information-containing labels, and sign holder-supporting members comprising a pair of sign holder-receiving lip members carried by said front surface of said cover member and defining spaced, opposing sign holder-receiving pockets carried substantially entirely by said front surface of said cover member for removably receiving at least one sign holder adapted to display an information-containing sign forwardly of said label holder, whereby labels can be selectively inserted and removed from said pocket without removing a sign holder carried by said cover member.

2. A merchandising aid according to claim 1, wherein said sign holder-receiving lip members include upper sign holder-receiving lip members defining an upper sign holder-receiving pocket extending along the upper edge portions of said cover member, further including an upper grip member defining an upper grip pocket between said upper sign holder-receiving members and said front surface of said cover member.

3. A merchandising aid according to claim 1, wherein said sign holder-receiving lip members include lower sign holder-receiving lip members defining a lower sign holder-receiving pocket extending along the lower edge portions of said cover member, further including a lower grip member defining a lower grip pocket between said lower sign holder-receiving members and said front surface of said cover member.

4. A merchandising aid according to claim 1, wherein said sign holder-receiving lip members include upper and lower sign holder-receiving lip members defining upper and lower sign holder-receiving pockets extending along the upper and lower edge portions of said cover member, respectively, further including an upper and lower grip member defining upper and lower grip pockets between said upper and lower sign holder-receiving members, respectively, and said front surface of said cover member.

5. A merchandising aid according to claim 1, further including adhesive on at least a portion of said rear surface of said body panel for securing said merchandising aid to the supporting surface.

6. A merchandising aid according to claim 5, wherein the supporting surface includes a downwardly depending flange member at the front of a merchandise shelf having an elongated (lower edge, a rearwardly and upwardly extending arm carried by said rear surface of said body panel and adapted for engagement under the lower edge of the flange member.

7. A merchandising aid according to claim 1, wherein the supporting surface includes a C-channel at the front of a merchandise shelf, the C-channel having upper and lower edge portions, a forwardly and downwardly extending upper lip member at the upper edge portions of the C-channel, said upper edge portions of said body panel being adapted for engagement under the upper lip member of the C-channel, and engaging means carried by said body panel in spaced relationship to said upper edge portions of said body panel for engagement with portions of the C-channel spaced from the upper lip member of the C-channel.

8. A merchandising aid according to claim 7, wherein said engaging means includes a rearwardly and upwardly extending arm carried by said rear surface of said body panel and adapted for engagement under the lower edge portions of the C-channel.

9. A merchandising aid according to claim 7, wherein the C-channel further includes a forwardly and upwardly extending lower lip member at the lower edge portions of the C-channel, and said engaging means includes portions of said body member adapted for engagement above the lower lip member of the C-channel.

10. A merchandising aid according to claim 9, wherein said portions of said body panel comprise said lower edge portions of said body panel.

11. A merchandising aid according to claim 9, wherein said portions of said body panel comprise a finger extending rearwardly and downwardly from said rear surface of said body panel.

12. A merchandising aid according to claim 7, further including said upper edge ions of said body panel including a forwardly and downwardly extending flange, said upper edge port portions of said cover member lockingly engageable under said flange, and a downwardly and forwardly extending finger-engaging element carried by said upper edge portions of said cover member and adapted to facilitate releasing said upper edge portions of said cover member from locking engagement with said flange of said base panel.

13. In combination, a supporting surface, a merchandising aid according to claim 1, and a sign holder, said merchandising aid being secured to said supporting surface, and said sign holder being removably carried by said sign holder-supporting members on said front surface of said cover member of said label holder.

14. The combination of claim 13, further including at least one non-adhesive label removably received in said pocket between said front surface of said body panel and said rear surface of said cover member, and a sign removably carried by said sign holder.

15. The combination of claim 13, wherein said sign holder comprises a pair of elongated spaced edge portions, and said sign holder-supporting members comprise a pair of sign holder-receiving lip members carried by said front surface of said cover member and defining spaced, opposing sign holder-receiving pockets, said edge portions of said sign holder being engaged in said sign holder-receiving pockets.

16. The combination of claim 15, wherein said sign holder comprises a resilient member defining said spaced edge portions, said edge portions of said sign holder being snappingly engaged in said sign holder-receiving pockets.

17. The combination of claim 15, wherein said sign holder-receiving lip members include an upper sign holder-receiving lip member extending forwardly and downwardly from said upper edge portions of said cover member to define an upper sign holder-receiving pocket, and a lower sign holder-receiving lip member extending forwardly and upwardly from said lower edge portions of said cover member to define a lower sign holder-receiving pocket.

18. The combination of claim 17, wherein said sign holder comprises a panel member having a reverted upper flap with an upper bight portion defining an elongated upper edge portion engaged in said upper sign holder-receiving pocket, and a free lower edge defining an elongated lower edge portion received in said lower sign holder-receiving pocket.

19. The combination of claim 13, wherein said sign holder-receiving lip members include upper sign holder-receiving lip members extending forwardly and downwardly from said upper edge portions of said cover member and lower sign holder-receiving lip members extending forwardly and upwardly from said lower edge portions of said cover member, and a grip member behind at least one of said upper and lower sign holder-receiving lip members defining a grip pocket for slidably receiving and removably retaining portions of an additional label or sign.

20. The combination of claim 19, wherein said grip member defines an upper grip pocket behind said upper sign holder-receiving lip members.

21. The combination of claim 19, wherein said grip member defines a lower grip pocket behind said lower sign holder-receiving lip members.

22. The combination of claim 19, further including upper and lower grip members defining upper and lower grip pockets behind said upper and lower sign holder-receiving lip members, respectively.

23. The combination of claim 13, further including adhesive on said rear surface of said body panel securing said merchandising aid to said supporting surface.

24. The combination of claim 23, wherein said supporting surface includes a downwardly depending flange member at the front of a merchandise shelf having an elongated lower edge, a rearwardly and upwardly extending arm carried by said rear surface of said body panel and engaged under said lower edge of said flange member.

25. The combination of claim 13, wherein said supporting surface includes a C-channel at the front of a merchandise shelf having upper and lower edge portions, a forwardly and downwardly extending upper lip member at said upper edge portions of said C-channel, said upper edge portions of said body panel being engaged under said upper lip member of said C-channel, and engaging means can-led by said body panel in spaced relationship to said upper edge portions of said body panel, said engaging means being engaged with portions of said C-channel spaced from said tipper lip member of said C-channel.

26. The combination of claim 25, wherein said engaging means includes a rearwardly and upwardly extending arm carried by said rear surface of said body panel and engaged under said lower edge portions of said C-channel.

27. The combination of claim 25, wherein said C-channel further includes a forwardly and upwardly extending lower lip member at said lower edge portions of said C-channel, and said engaging means includes portions of said body panel engaged above said lower lip member of said C-channel.

28. The combination of claim 27, wherein said portions of said body panel comprise said lower edge portions of said body panel.

29. The combination of claim 27, wherein said portions of said body panel comprise a finger extending rearwardly and downwardly from said rear surface of said body panel.

30. A merchandising aid according to claim 25, further including said upper edge portions of said body panel including a forwardly and downwardly extending flange, said upper edge portions of said cover member lockingly engageable under said flange, and a downwardly and forwardly extending finger-engaging element carried by said upper edge portions of said cover member and adapted to facilitate releasing said upper edge portions of said cover member from locking engagement with said flange of said body panel.

31. A merchandising aid for displaying at least one information-containing label and for supporting at least one sign holder adapted to display an information-containing sign, said merchandising aid being adapted to be secured to a supporting surface and including a label holder having a body panel and a transparent cover member, said body panel and said cover member each having front and rear surfaces and upper and lower edge portions, said body panel and said cover member being flexibly secured to each other at only one of their respective upper and lower edges to define between said front surface of said body panel and said rear surface of cover member a pocket for removable reception of one or more information-containing labels, and sign holder-supporting members carried substantially entirely by said front surface of said cover member for removably receiving at least one sign holder adapted to display an information-containing sign forwardly of said label holder, whereby labels can be selectively inserted and removed from said pocket without removing a sign holder carried by said cover member, and wherein the sign holder comprises a pair of elongated spaced edge portions, and said sign holder-supporting members comprise a pair of sign holder-receiving lip members carried by said front surface of said cover member and defining spaced, opposing sign holder-receiving pockets adapted to removably receive the edge portions of the sign holder.

32. A merchandising aid according to claim 31, wherein the sign holder comprises a resilient member defining said spaced edge portions, the edge portions of the sign holder being adapted to be snappingly engaged in said sign holder-receiving pockets.

33. A merchandising aid according to claim 31, wherein said sign holder-receiving lip members include an upper sign holder-receiving lip member extending forwardly and downwardly from said upper edge portions of said cover member to define an upper sign holder-receiving pocket, and a lower sign holder-receiving lip member extending forwardly and upwardly from said lower edge portions of said cover member to define a lower sign holder-receiving pocket.

34. A merchandising aid according to claim 33, wherein the sign holder comprises a panel member having a reverted upper flap with an upper bight portion defining an elongated upper edge portion adapted to be engaged in said upper sign holder-receiving pocket, and a free lower edge defining an elongated lower edge portion adapted to be received in said lower sign holder-receiving pocket.

* * * * *